US005244102A

United States Patent [19]

Koenig

[11] Patent Number: 5,244,102

[45] Date of Patent: Sep. 14, 1993

[54] CAP RECEIVING APPARATUS

[76] Inventor: Robert H. Koenig, 1904 Amy, Baytown, Tex. 77520

[21] Appl. No.: 805,029

[22] Filed: Dec. 11, 1991

[51] Int. Cl.[5] ..... A47F 7/00

[52] U.S. Cl. ..... 211/32; 211/87

[58] Field of Search ..... 211/30, 32, 87, 31, 211/88; 248/176, 146

[56] References Cited

U.S. PATENT DOCUMENTS

| | | | |
|---|---|---|---|
| 32,689 | 5/1900 | Hubbard | 211/32 X |
| 915,393 | 3/1909 | Walker | 211/32 X |
| 960,592 | 6/1910 | Smith, Jr. . | |
| 1,116,706 | 11/1914 | Hutt . | |
| 1,608,497 | 11/1926 | Fischer . | |
| 1,799,395 | 4/1931 | Shoer . | |
| 2,461,178 | 2/1949 | Reinke | 211/32 |
| 2,494,487 | 1/1950 | Pfeil | 211/32 |
| 2,494,488 | 1/1950 | Pfeil | 211/32 |
| 2,626,712 | 1/1953 | Frush | 211/32 |
| 2,783,895 | 3/1957 | Lynch | 211/32 |
| 3,737,081 | 5/1973 | James | 223/84 |
| 4,515,334 | 5/1985 | Horne | 248/146 |
| 5,086,931 | 2/1992 | Cobb | 211/32 |
| 5,137,157 | 8/1992 | Lawson | 211/32 |

*Primary Examiner*—Alvin C. Chin-Shue
*Attorney, Agent, or Firm*—Harrison & Egbert

[57] ABSTRACT

A cap receiving apparatus having a member with a generally flat back surface. The member has a slot extending through the thickness of the member and having a generally elliptical configuration. The slot is angled through the thickness of the member such that the slot is further from the back surface at a top of the member than at the bottom of the member. The slot is suitable for receipt of a bill of a cap. The member has a generally elliptical outer surface extending from the flat back surface in generally parallel relation to the elliptical slot. A panel is fastened to the back surface of the member such that the member extends outwardly perpendicularly to the panel. A second member may be fastened to the panel in parallel relation to the first member and in alignment to the first member.

16 Claims, 2 Drawing Sheets

CAP RECEIVING APPARATUS

TECHNICAL FIELD

The present invention relates to apparatus for the receipt of caps. More particularly, the present invention relates to displays and racks for the collection and storing of caps.

BACKGROUND ART

Recently, there has been a proliferation of give-away caps (otherwise known as "gimme caps"). These caps are generally inexpensive caps which include a business logo prominently displayed thereon. It is quite common for persons to accumulate a large number of these caps. These caps are often accumulated so as to form a personal collection of caps. Often, those who collect such caps desire to prominently display their collection within their home. These caps generally take up a large amount of room and are generally considered to be unsuitable for vertical storage.

Various apparatus have been constructed in the past for the storage of hats. U.S. Pat. No. 960,592, issued on Jun. 7, 1910, to G. Smith, Jr., describes a hat hanger in which a clip is provided on a vertical panel for receiving the rim of the hat. An abutment surface is provided at the lower part of the vertical panel so as to position the hat against the vertical panel. U.S. Pat. No. 1,116,706, issued on Nov. 10, 1914, to J. F. Hutt shows another type of hat rack in which a bent wire is provided in a configuration suitable for supporting the crown of a hat and supporting the edge of the hat brim. U.S. Pat. No. 1,608,497, issued on Nov. 30, 1926, to C. Fischer shows a horizontal arrangement for receiving and storing hats and caps in which each of the caps is supported along the crown of the hat. U.S. Pat. No. 1,799,395, issued on Apr. 7, 1931, to G. G. Shoer provides a combined coat and hat hook for supporting a hat against the surface. U.S. Pat. No. 2,461,178, issued on Feb. 8, 1949, to F. A. Reinke shows a hat and tie holder in which a bar is suitably bent so as to receive the crown of hats and support a plurality of the hats in a horizontal arrangement. U.S. Pat. No. 2,494,487, issued on Jan. 10, 1950, to E. W. Pfeil provides a vertical storage system for hats. Each of the hats is supported in a frame attached to a vertical panel. U.S. Pat. No. 2,783,895, issued on Mar. 5, 1957, provides a hat support having a curved surface for receiving the brim and the crown of a hat. U.S. Pat. No. 2,626,712, issued on Jan. 27, 1953, to W. H. Frusch discloses a hat hanger having an attachment for connection to an external surface and a bent wire for receiving a crown of a hat. U.S. Pat. No. 3,737,081, issued on Jun. 5, 1973, to F. R. James shows a device for holding, storing, and maintaining the shape of a western hat.

None of these prior art devices is particularly adapted for receiving the "gimme caps". Also, these prior art devices are not capable of storing a plurality of such caps in a vertical configuration. These devices are not suitable for displaying the logo of such caps outwardly therefrom. These prior art devices also have the tendency to deform the hat or cap during storage.

It is an object of the present invention to provide a cap rack which is capable of storing a plurality of caps in a vertical configuration.

It is another object of the present invention to provide a cap rack which maintains the shape of the cap and which maintains the cap in a natural position.

It is a further object of the present invention to provide a cap rack which allows for the display of logos on the front of the cap.

It is still another object of the present invention to provide a cap rack which is easy to manufacture, simple to use, easy to install, and relatively inexpensive.

These and other objects and advantages of the present invention will become apparent from a reading of the attached specification and appended claims.

SUMMARY OF THE INVENTION

The present invention is a cap rack which comprises a panel, a first horizontal cap receiving member fastened to and extending parallel to the panel and a second horizontal cap receiving member fastened to a different location on the panel and extending perpendicularly to the panel in parallel relation to the first horizontal cap receiving member. The first horizontal cap receiving member has a first curved slot extending therethrough. This first curved slot is for the receipt of a bill of a first cap. The second horizontal cap receiving member also has a second curved slot extending therethrough. This second curved slot is also for the receipt of a bill of a cap.

The panel is a generally vertical panel. The first and second horizontal cap receiving members are in alignment along the vertical panel. A suitable attachment mechanism is connected to a surface of the panel opposite the cap receiving members for allowing the panel to be attached to an exterior surface, such as a wall, or other object.

The cap receiving members have a generally flat surface fastened to the panel. These cap receiving members also have a generally elliptical surface extending outwardly from this flat surface. The elliptical surface is positioned so as to be juxtaposed against a portion of a cap located in an adjacent cap receiving member. The first curved slot extends through the thickness of the cap receiving members. The curved slot is angled through the thickness of the cap receiving members such that the curved slot is further from the panel at the top of the receiving member than at the bottom of the receiving member. The curved slot is angled inwardly from the top to the bottom at generally fifteen degrees (15°) relative to the panel. This curved slot also has a generally elliptical curvature in generally parallel relation to the elliptical surface of the cap receiving member. This curved slot has a width of between one-quarter inch and one-half inch.

DETAILED DESCRIPTION OF THE INVENTION

Figure 1:
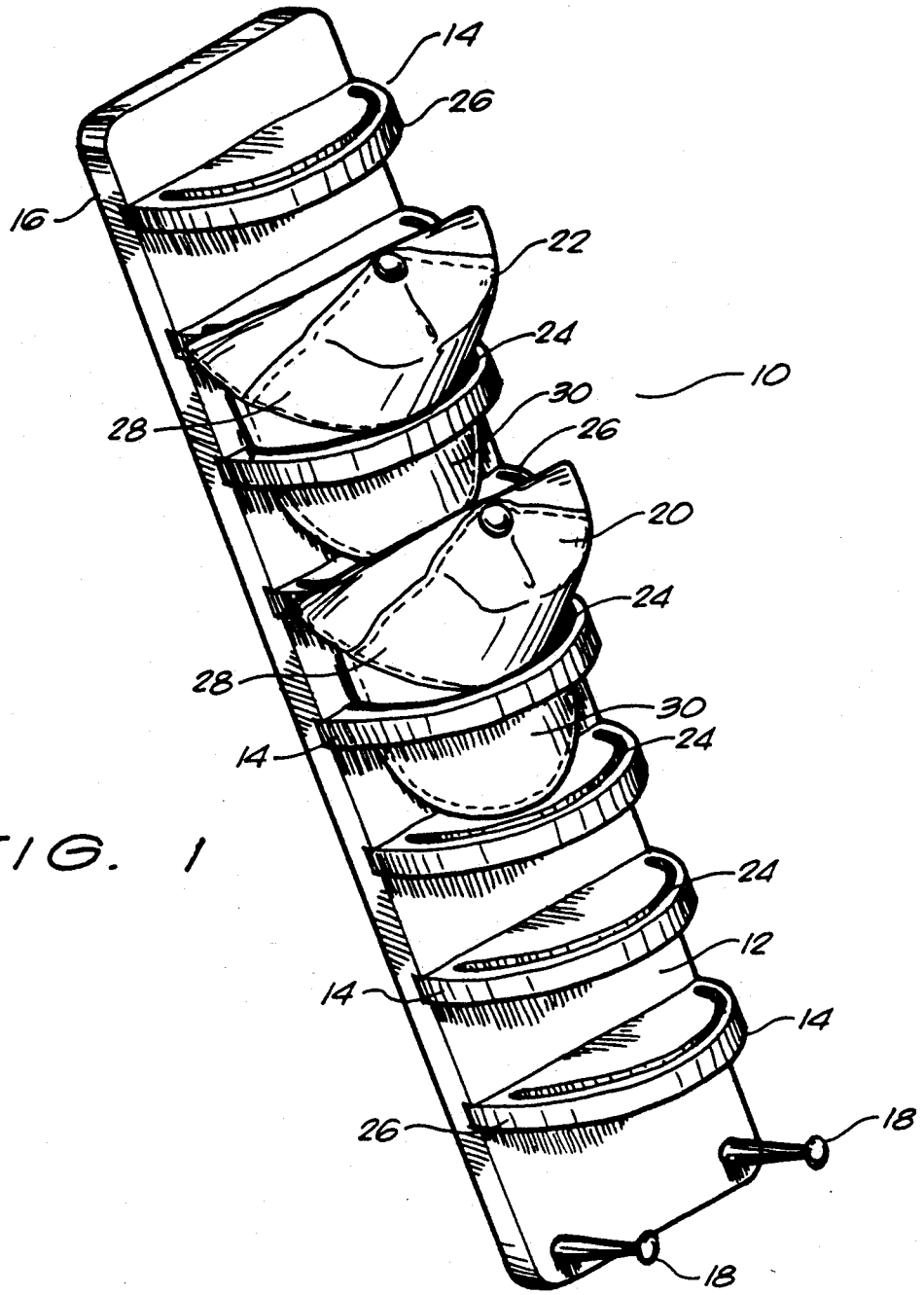
FIG. 1 is a perspective view of the cap rack in accordance with the preferred embodiment of the present invention.

Referring to FIG. 1, there is shown at 10 the cap rack in accordance with the preferred embodiment of the present invention. Cap rack 10 comprises the vertical panel 12 and the horizontal cap receiving members 14.

Suitable means are provided on the back surface 16 of panel 12 so as to allow panel 12 to be fastened to an exterior surface, such as a wall, a door, or other location.

The panel 12 is a generally vertical panel having a thickness suitable for receiving each of the horizontal members 14. In FIG. 1, it can be seen that the panel 12 is generally rectangular in configuration. It should be noted that, within the concept of the present invention, panel 12 can take on a wide variety of configurations. It is only important that panel 12 be of a character suitable for supporting each of the horizontal members 14 thereon.

In FIG. 1, it can be seen that a plurality of horizontal members 14 are attached to the front surface of panel 12. Each of the horizontal members 14 can be attached to the panel 12 by adhesives, screws, keys, or other conventional means of attachment. Panel 12 also supports pegs 18. Pegs 18 are used for the receipt of coats, hats, or other items that can be suspended on the outwardly extending pegs 18.

FIG. 1 illustrates how the horizontal receiving members 14 support caps 20 and 22 therein. Each of the horizontal members 14 has a slot 24 formed therethrough. Slot 24 has a generally elliptical configuration and extends through the thickness of each of the horizontal members 14. Each of the horizontal members 14 is positioned on panel 12 in parallel relation to an adjacent horizontal receiving member 14. When the horizontal receiving members 14 are placed on a vertical panel 12, each of the members is in alignment with adjacent members. As such, the slot 24 in each of the horizontal receiving members 14 is generally aligned with a slot in an adjacent horizontal receiving member 14.

Each of the horizontal receiving members 14 has a generally elliptical shaped exterior surface 26 which extends outwardly from the panel 12. The elliptical exterior surface 26 forms an abutment surface for receiving the back side of the crown 28 of the cap 20 and 22. It is unique to the present invention that each of the caps 20 and 22 is mounted with the crown 28 of the cap folded inwardly. The common type of cap which is used within the present invention is of a type that should be folded inwardly during storage. As such, the surface 26 acts as an abutment surface against the folded crowns 28 of caps 20 and 22. By the provision of such an abutment surface by elliptical exterior surface 26, each of the caps 20 and 22 is supported in proper position such that the logo on the forward portion of caps 20 and 22 can be displayed toward a person looking at the cap rack 10 and can be protected against deformation during storage.

It can further be seen that the elliptical slots 24 serve to receive the bills 30 of caps 20 and 22. Since it is conventional for the bills SO to have a generally elliptical cross-sectional configuration, the shaping of slots 24 in an elliptical form properly receives the bill 30 without any distortion or any folding of the bill 30. As such, the particular elliptical configuration of slot 24 maintains the quality of the cap during storage on rack 10.

Conventionally, the vertical panel 12 and the horizontal members 14 are made of wood material. However, it may be possible for the cap rack 10 to be manufactured of a plastic material.

Figure 2:
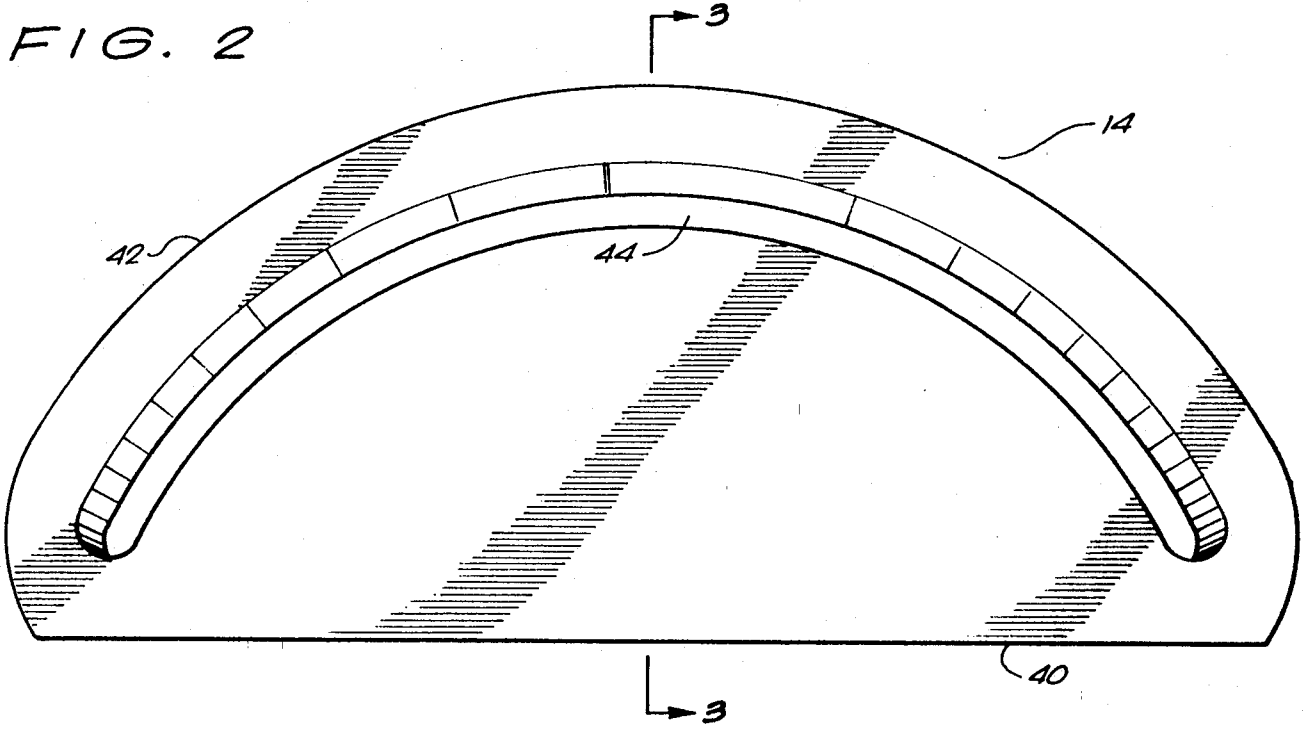
FIG. 2 is a top view of the cap receiving member of the present invention.

FIG. 2 provides an isolated illustration of a horizontal member 14. Additionally, it can be seen that horizontal member 14 includes a flat back surface 40. The flat back surface 40 is the surface which is joined to the surface of the vertical panel 12. An elliptical outer surface 42 extends from this flat back surface 40. A slot 44 extends through the thickness of the horizontal member 14. The slot 44 has a generally elliptical configuration in generally parallel relation to the elliptical outer surface 42. It can be seen that the slot 44 is suitable for the receipt of a bill of a cap. The proper configuration of the slot 44 is that it has a width of between one-quarter inch and one-half inch. Experiments have shown that a slot having a width of less than one-quarter of an inch will unnecessarily crimp the bill of a cap. If the slot 44 has a thickness of greater than one-half inch, then the cap will be too loosely received by the slot and will have a tendency to hang loosely and present an unattractive appearance.

Figure 3:
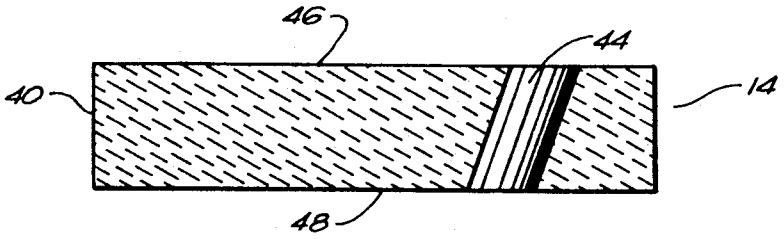
FIG. 3 is a cross-sectional view taken across line 3—3 of FIG. 2.

FIG. 3 shows the cross-section of the horizontal member 14. Initially, it can be seen that horizontal member 14 is a generally solid member throughout its thickness. Slot 44 extends from the top surface 46 to the bottom surface 48 of horizontal member 14. Slot 44 is configured so that the slot will be further from the back surface 40 on the top 46 than at the bottom 48. Specifically, slot 44 is angled at approximately fifteen degrees (15°) relative to the back surface 40. The angling of the slot 44 is important to the configuration of the present invention. The angling of slot 44 allows the cap to assume a posture in which it can be properly supported by the exterior surface 42 of an adjacent horizontal member 14. This angling of the slot 44 also allows for the more proper display of the logo on the cap and also allows for a larger number of caps to be properly included within the cap rack 10. The angling of slot 44 also increases the accessibility of the cap to anyone wishing to remove the cap from the rack 10.

The present invention provides an effective display for gimme caps. A large number of the caps can be retained and displayed on the cap rack in a convenient accessible fashion. The logos of each of the caps is somewhat prominently displayed by the use of the special configuration of the receiving member 14. The present invention eliminates the problem of the scattering of the caps and eliminates the space requirements of accumulating a large number of such caps. The special configuration of the slot and of the exterior surface of the receiving member preserves the quality of the cap during storage. The slot will prevent unnecessary crimping of the bill of the cap. The elliptical exterior surface retains the crown of the cap in its properly folded configuration. Adequate support is provided so as to prevent the cap from falling or from collapsing upon itself.

The foregoing disclosure and description of the invention is illustrative and explanatory thereof. Various changes in the details of the illustrated apparatus may be made within the scope of the appended claims without departing from the true spirit of the invention. The present invention should only be limited by the following claims and their legal equivalents.

I claim:

1. A cap rack comprising:

a panel;

a first horizontal cap receiving member fastened to and extending perpendicular to said panel, said first horizontal cap receiving member having a first curved slot extending therethrough, said first curved slot for receipt of a bill of a first cap, said first curved slot extending through a thickness of said first horizontal cap receiving member, said first curved slot being angled through the thickness of said first horizontal cap receiving member such that said first curved slot is further from said panel at a top of said first horizontal cap receiving member than at a bottom of said first horizontal cap receiving member; and a second horizontal cap receiving member fastened to a different location on said panel than said first horizontal cap receiving member, said second horizontal cap receiving member extending perpendicular from said panel in parallel relation to said first horizontal cap receiving member, said second horizontal cap receiving member having a second curved slot extending therethrough, said second curved slot for the receipt of a bill of a second cap.

2. The cap rack of claim 1, said panel being a vertical panel, said first and second horizontal cap receiving members in alignment along said vertical panel.

3. The cap rack of claim 1, said panel comprising:

attachment means connected to a surface of said panel opposite said first and second horizontal cap receiving members for attaching said panel to an exterior surface.

4. The cap rack of claim 1, said first horizontal cap receiving member having a generally flat surface fastened to said panel, said first horizontal cap receiving member having a generally elliptical surface extending outwardly from said flat surface, said elliptical surface positioned so as to be juxtaposed against a portion of a second cap positioned in said second horizontal cap receiving member.

5. The cap rack of claim 1, said first curved slot angled generally fifteen degrees inwardly from the top to the bottom relative to said panel.

6. The cap rack of claim 4, said first curved slot having a generally elliptical curvature in generally parallel relation to said elliptical curvature of said first horizontal cap receiving member.

7. The cap rack of claim 1, said first curved slot having a width of between one-quarter inch and one-half inch.

8. A cap receiver comprising:

a member having a generally flat back surface and an elliptical outer surface extending from said flat back surface, said member having a slot extending through a thickness of said member, said slot having a generally elliptical configuration in generally parallel relation to said elliptical outer surface, said slot suitable for the receipt of a bill of a cap, said slot angled through the thickness of said member such that said slot is further from said back surface at a top of said member than at a bottom of said member.

9. The cap receiver of claim 8, said slot angled inwardly from the top to the bottom at generally fifteen degrees relative to said back surface.

10. The cap receiver of claim 9, said slot having a width of between one-quarter inch and one-half inch.

11. The cap receiver of claim 8, said back surface comprising:

attachment means connected to said back surface for attaching said member to an exterior surface.

12. A cap receiver comprising:

a member having a generally flat back surface, said member having a slot extending through a thickness of said member, said slot having a generally elliptical configuration, said slot angled through the thickness of said member such that said slot is further from said back surface at a top of said member than at a bottom of said member, said slot suitable for the receipt of a bill of a cap.

13. The cap receiver of claim 12, said member having a generally elliptical outer surface extending from said flat back surface, said elliptical slot in generally parallel relation to said elliptical outer surface.

14. The cap receiver of claim 12, said slot angled inwardly from the top to the bottom at generally fifteen degrees relative to said back surface.

15. The cap receiver of claim 12, further comprising:

a panel fastened to said back surface such that said member extends outwardly perpendicular to said panel; and attachment means connected to said panel on a side opposite said member, said attachment means for attaching said panel to an exterior surface.

16. The cap receiver of claim 15, further comprising:

a second member fastened to said panel in parallel relation to said first member, said second member having a configuration corresponding to and in alignment with said first panel.

* * * * *